343-909 SR
3/23/82 XR 4,321,604

United States Patent [19]
Ajioka

[11] 4,321,604
[45] Mar. 23, 1982

[54] BROADBAND GROUP DELAY WAVEGUIDE LENS

[75] Inventor: James S. Ajioka, Fullerton, Calif.

[73] Assignee: Hughes Aircraft Company, Culver City, Calif.

[21] Appl. No.: 126,075

[22] Filed: Feb. 29, 1980

Related U.S. Application Data

[63] Continuation of Ser. No. 842,847, Oct. 17, 1977.

[51] Int. Cl.[3] ..... H01Q 15/06
[52] U.S. Cl. ..... 343/753; 343/909
[58] Field of Search ..... 343/753–756, 343/909, 910, 911 R

[56] References Cited

FOREIGN PATENT DOCUMENTS 838333 5/1952 Fed. Rep. of Germany ..... 343/909

OTHER PUBLICATIONS

Dion, A Wideband Waveguide Lens, Technical Note 1977–1978, Lincoln Laboratory, Feb. 2, 1977.

*Primary Examiner*—Eli Lieberman
*Attorney, Agent, or Firm*—Paul M. Coble; W. H. MacAllister

[57] ABSTRACT

A broadband group delay waveguide lens utilizing an array of half wave plates is disclosed. The lens is comprised of an array of uniformly spaced sections of waveguide having various lengths. The waveguide lengths are selected so as to provide an equal time delay to all rays from the focal point to the aperture plane of the lens. Since equal time delay does not ensure equality of phase at the aperture plane, half wave plates are inserted in the waveguide elements for adjusting the phase of each ray to obtain a constant phase plane over the aperture plane at the design frequency. The inner surface of the lens is spherical with the radius of the sphere equalling the focal length of the lens. The outer surface may be ellipsoidal having a semi-minor axis equal to the focal length and the semi-major axis is dependent upon the waveguide cross section dimensions and the design frequency. Such a lens has a low aperture phase error over a relatively large frequency range.

10 Claims, 11 Drawing Figures

Fig. 7a.
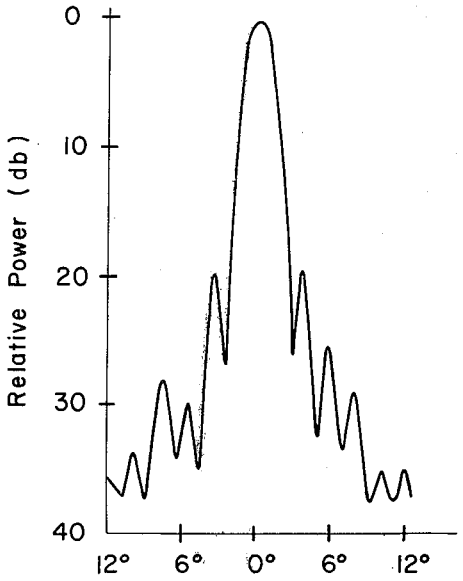
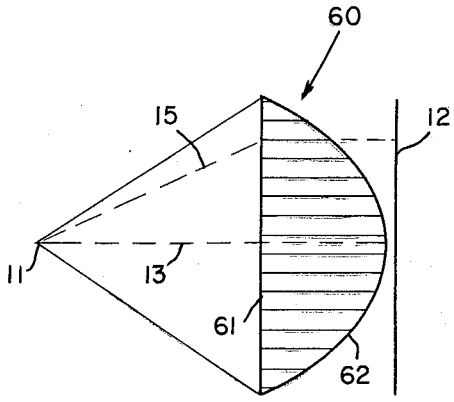
Fig. 10.
Fig. 7b.
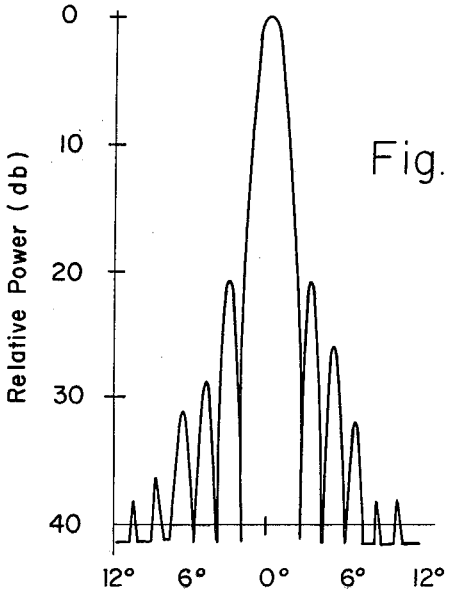
Fig. 7c.
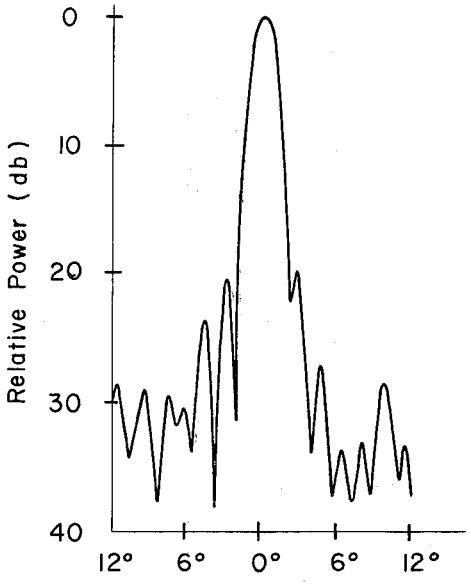

BROADBAND GROUP DELAY WAVEGUIDE LENS

The government has rights in this invention pursuant to Contract No. F04701-76-C-0093 awarded by the Department of the Air Force.

This is a continuation at application Ser. No. 842,847, filed Oct. 17, 1977.

BACKGROUND OF THE INVENTION

1. Field of the Invention

The invention relates generally to microwave antenna systems, and in particular to a broad bandwidth waveguide lens for providing a constant phase aperture plane.

2. Description of the Prior Art

Microwave scanning antenna systems are generally known in the prior art. So, too, are waveguide lenses for use in conjunction with such antenna systems. A constrained microwave lens or waveguide lens is comprised of an array of waveguide sections, and is utilized to produce a plane phase front at the aperture. The prior art lenses having the broadest bandwidth are the ones having an equal time delay of all the rays from the focal point to the aperture, regardless of frequency. One such broad bandwidth lens is the "bootlace" lens. Lenses that deviate most from the equal time delay principle have narrowest bandwidth, and the bandwidth increases as equal time is approached. Conventional waveguide lenses based upon the principle of equal phase delay are very narrow in bandwidth because there is a very large difference in time delay between the central and edge rays. Since the index of refraction of waveguides is less than unity, the lens' outer surface is concave in contour, with the largest lengths of waveguide at the edge of the lens where the path is inherently longest.

Conventional waveguide lenses may be "zoned" to either increase bandwidth or minimize weight. In "zoning" the waveguide lens is divided into concentric annular rings or zones. Incrementally varying portions of the individual waveguides are removed within each annular zone. Zoning the lens removes the waveguide in increments of differential phase between the waveguide and free space at the zone steps. This process diminishes the difference in time delay among the various rays; hence bandwidth is improved. Zoning for minimum weight as is conventionally done produces an aperture phase distributed at off-design frequency which is sawtooth with a mean value that increases quadratically from the center of the lens to the edge. Coulbourn has been able to improve the bandwidth of a zoned lens by adding thickness to the central portion of the lens. The added thickness allows the number of zones to be increased and makes the time delay nearly equal at discrete points in each zone. The aperture phase distribution of the Coulbourn lens at frequency off the design frequently is sawtooth, with a mean error of zero. Both the zoned and the Coulbourn lenses are difficult and expensive to manufacture due to the zoning. Also, such lenses do not lend themselves easily to the use of a radome, due to their uneven and complex surfaces.

Another type of lens is the constant thickness waveguide lens wherein the waveguides have a constant thickness, and phase correction of off axis-rays is achieved by means of phase shifters inserted into the waveguide elements. Because the phase shift is constant with frequency, the constant thickness half wave plate lens is narrow band.

SUMMARY OF THE INVENTION

Accordingly, it is an object of the present invention to provide a waveguide lens which is simple, less expensive and less lossy than prior art lenses.

It is another object of the present invention to provide a broad band waveguide lens.

It is another object of the present invention to provide a microwave waveguide lens having an aperture phase distribution which is essentially constant over a wide frequency range.

It is still another object of the present invention to provide a waveguide lens having an equal time delay for all rays from a focal point to the aperture plane.

It is another object of the present invention to provide a microwave antenna system for generating a signal having an aperture phase distribution with a minimum phase error.

In accordance with the foregoing objects, a waveguide lens having a focal point and an aperture includes an array of waveguides each having a predetermined length depending upon the position of each individual waveguide within the arrays. The waveguide lens has first and second smooth surfaces having predetermined contours for providing equal time delay for all rays between the focus and the aperture plane. A half wave plate phase shifting element is included within each waveguide for providing a constant phase plane at the aperture.

BRIEF DESCRIPTION OF THE DRAWINGS

FIG. 7 is a waveform diagram illustrating the relative power in dB of the main beam and side lobes from the lens of an on axis horn antenna.

FIG. 10 is a diagram of a second embodiment according to the present invention.

DETAILED DESCRIPTION OF THE INVENTION

Figure 1:
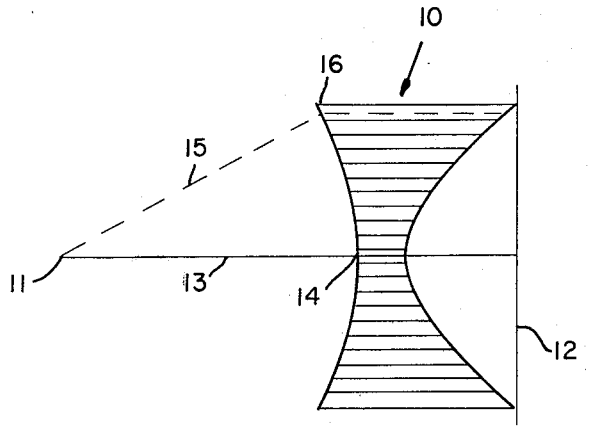
Fig. 1. PRIOR ART
FIG. 1 is a diagram illustrating a conventional waveguide lens according to the prior art.

Referring to FIG. 1, a conventional unzoned waveguide lens 10 according to the prior art is illustrated. The lens 10 has a focal point 11 where a horn antenna (not shown) is placed. The antenna propagates millimeter wavelength energy towards the lens 10, which provides a phase front at the aperture plane 12. The central ray 13 propagates through the central waveguide 14 and the edge ray 15 propagates through the edge waveguide 16. From the geometry of the prior art lens it may be seen that the edge ray 15 has a greater distance to traverse to the aperture plane than the central ray 13. Also, the edge ray 15 takes a greater time to propagate through the edge waveguide due to its greater length. Therefore, due to the time delay between the central and edge rays, the conventional waveguide lens is essentially a narrow band device.

Elements in the succeeding figures which are similar to the elements of FIG. 1 shall have the same reference designation numeral as in FIG. 1.

Figure 2:
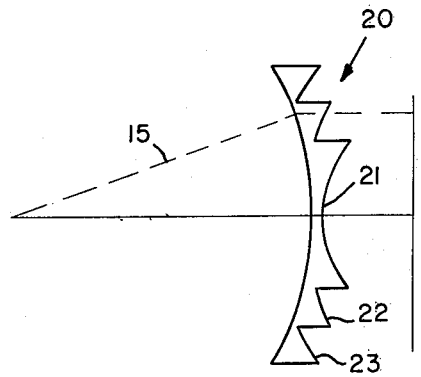
Fig. 2. PRIOR ART
FIG. 2 is a diagram illustrating a zoned waveguide lens according to the prior art.

Referring now to FIG. 2, a zoned waveguide lens 20 according to the prior art is illustrated. One method utilized to decrease the time delay between the central and edge rays, 13 and 15, respectively, is by removing portions of the waveguide lens in steps or zones such as zones 21, 22 and 23. The difference in distance traveled between the central and edge rays 13 and 15, respectively, is minimized according to the equation:

$$\Delta L = \frac{\lambda\lambda_g}{\lambda_g - \lambda}$$

where

- $\Delta L$ is the difference in waveguide lengths, or in other words the depth of the step,
- $\lambda_g$ is the wavelength of a general ray at the center frequency, and
- $\lambda$ is the wavelength of a ray at one end of the design frequency.

The zoned waveguide lens has an improved bandwidth over the conventional waveguide lens of FIG. 1 due to the improved differential in time delay.

Figure 3:
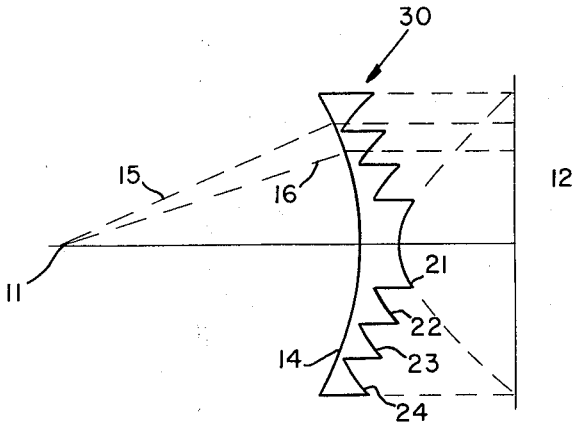
Fig. 3. PRIOR ART
FIG. 3 is a diagram illustrating a phase compensated (Coulbourn) lens according to the prior art.

The Coulbourn lens 30 of FIG. 3 is an improvement over the zoned lens of FIG. 2. The bandwidth of the lens 30 is increased by providing greater thickness to the central waveguides so that the lens may have more zones than the conventional zoned lens. Thus, the time delay is nearly equal at discrete points in each zone. This results in an aperture phase distribution at frequencies off the design frequency which is sawtooth with a mean error of zero is is illustrated in FIG. 9*b*.

Figure 4A:
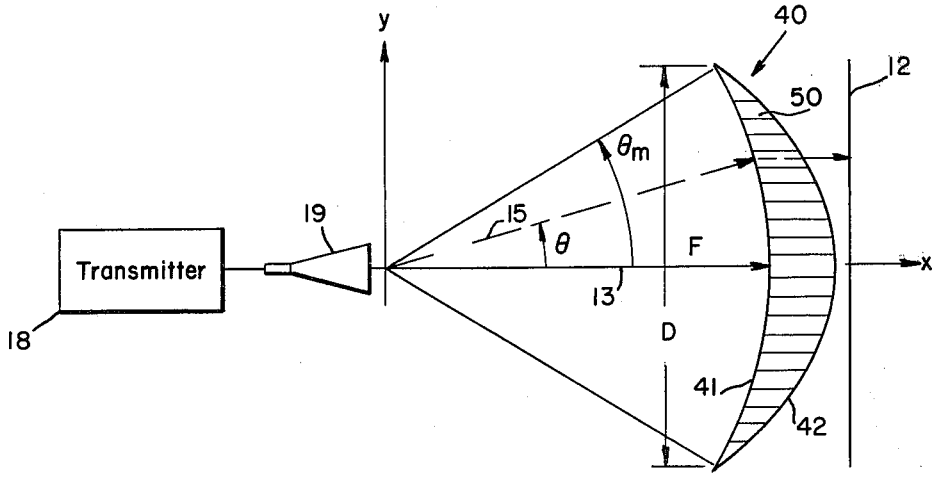
FIG. 4*a* is a diagram illustrating a cross section view of a waveguide lens according to the present invention.

Referring now more specifically to FIG. 4*a*, a cross-sectional view of a waveguide lens 40 according to the present invention is now described. The waveguide lens 40 includes an array of parallel uniformly spaced waveguide sections 50 of various lengths for propagating microwave energy from a horn antenna 19 which is connected to a transmitter 18. The lens 40 provides sufficient time delay to each of the rays such that all the rays traverse the distance from the focal point to the aperture plane 12 in the same time period. The waveguide lens 40 has smooth inner and outer surfaces 41 and 42 which form the boundaries of the waveguide elements 50. The inner surface 41 of the lens 40 may be any preselected smooth surface such as a plane or a curve. The illustrated embodiment has a spherical surface with the radius of the sphere being equal to the focal length of the lens. Inner surface 41 may be any other arbitrary shape, but the spherical surface ensures that the Abbe sine condition is satisfied for wide angle performance. Satisfaction of this condition is particularly important for scanning the beam by lateral feed movement or for multi-beam designs, since a slight movement off the axis will not cause the antenna to be out of focus. For a more detailed discussion of the Abbe sine function, refer to M. Born and E. Wolf, "Principles of Optics," Pergamon Press, 5th Edition, 1975.

The outer lens surface 42 is determined by the imposition of constant time delay for all rays from the focal point 11 to the aperture plane 12. For a spherical inner surface 14, the outer surface 42 is an ellipsoid having a semi-minor axis which is equal to the focal length and a semi-major axis which is dependent on the waveguide cross-sectional dimensions and the design frequency. A brief derivation of these results is given below.

As was discussed above, the inner and outer surfaces, 41 and 42, respectively, may be any arbitrary smooth surfaces which satisfy the requirements of equal time delay of all rays from the focal point to the aperture plane. For example, the focal point side 41 may be a flat surface and the aperture side 42 would be hyperbolic. If, on the other hand, the focal point side 41 is chosen as a hyperbole, the aperture side 42 would be a flat surface. Once a first smooth surface is selected, the second surface is determined by the shape of the first.

In the waveguide lens, like most optical lenses, the focal point and aperture plane are independent of the geometry of the lens. That is, the transmitter and antenna, 18 and 19, may be placed at what has been referred to as the outer surface 42 without degrading the performance of the lens 40.

The phase from the focal point to the aperture plane shown in FIG. 4*a* is given by $$\Phi(\theta) = kF + k_g l(\theta) + k l_a(\theta) + \Phi_H(\theta) \quad (1)$$

where

- $F$ = focal length
- $\theta$ = angle between lens axis and ray from focal point
- $k = 2\pi/\lambda$ = propagation constant for free space
- $k_g = 2\pi/\lambda_g$ = propagation constant in the waveguide
- $l(\theta)$ = length of center waveguide element
- $l_a(\theta)$ = path length from lens surface to aperture plane
- $\Phi_H(\theta)$ = phase due to half wave plate (independent of frequency).

Note that the lengths $l(\theta)$ do not include the lengths of waveguide necessary to accommodate the half wave plates; the half wave plates add a constant length to all elements.

The difference in phase $\Delta\Phi$ between a general ray and the central ray is:

$$\Delta\Phi = kg[l(0) - l(\theta)] - k l_a(\theta) - \Phi_H(\theta) \quad (2)$$

For maximum bandwidth, $\Delta\Phi$ is minimized as a function of frequency by setting $(d\Delta\Phi)/(d\omega) = 0$. Remembering that $(d\omega)/(dk) = c$ and $(d\omega)/(dk_g) = v_g$, where c is the free-space velocity and $v_g$ is the group velocity in the waveguide, leads to:

$$\frac{l(0)}{v_g} = \frac{l(\theta)}{v_g} + \frac{l_a(\theta)}{c} \quad (3)$$

where $v_g$ is given by $$v_g = \frac{d\omega}{dk_g} = c\sqrt{1 - \left(\frac{f_c}{f}\right)^2}$$

Result (3) says that bandwidth is maximized by requiring that all rays have equal group delay to the aperture reference plane. This result is the fundamental basis for design of the lens described herein.

The path length from the lens surface to the aperture plane shown in FIG. 4*a* is $$l_a(\theta)=F(1-\cos\theta)+l(0)-l(\theta) \tag{4}$$

Substituting (4) into (3) gives $$l(\theta) = l(0) - \frac{F(1-\cos\theta)}{c\left(\frac{1}{v_g}-\frac{1}{c}\right)} \tag{5}$$

In FIG. 4*a* the angle between the lens axis and the ray from the focal point to the edge of the lens is denoted by $\theta_m$. For this lens $l(\theta_m)=0$, and (5) yields $$l(0) = \frac{F(1-\cos\theta_m)}{c\left(\frac{1}{v_g}-\frac{1}{c}\right)} \tag{6}$$

A substitution of (6) into (5) then gives $$l(\theta) = \frac{F}{\left(\frac{c}{v_g}-1\right)}(\cos\theta-\cos\theta_m) \tag{7}$$

For a lens having diameter D, equation (7) can be placed in the form of an equation of an ellipse. The x coordinate of a point on the outer (elliptical) surface of the lens in FIG. 4*a* is given by $$x=F\cos\theta+l(\theta) \tag{8}$$

If we now define $$\xi = \left(\frac{c}{v_g}-1\right)^{-1} \tag{9a}$$

$$\zeta = \left(1-\frac{v_g}{c}\right)^{-1} \tag{9b}$$

a substitution of (7) into (8) yields $$x-F\cos\theta+\xi F\cos\theta-\zeta F\cos\theta_m \tag{10}$$

The y coordinate of the outer surface is $y=F\sin\theta$, and $\cos\theta_m$ in (10) is equal to $[1-(D/2F)^2]^{\frac{1}{2}}$. With these substitutions, (10) can be manipulated into the form $$\frac{x+\xi F\sqrt{1-\left(\frac{D}{2F}\right)^2}}{F^2\zeta^2}+\frac{y^2}{F^2}=1 \tag{11}$$

Equation (11) is that of an ellipse having a semi-minor axis equal to F and a semi-major axis equal to $\zeta F$.

At the design frequency, $\Phi(\theta)$ is adjusted to be zero by proper adjustment of the half wave plates. The waveguide element lengths, given by (7), are determined for equal time delay at the design frequency. With the subscript D referring to the design frequency, $$\Phi_D(\theta)=k_{gD}l_D(\theta)+k_D\{F(1-\cos\theta)+l_D(\theta)-l_D(\theta)\}-K_{gD}l_D(0) \tag{12}$$

where $\Phi_D(\theta)$ is the negative of the phase which must be produced by the half wave plates. The phase shift of the half wave plate is equal to twice the mechanical rotation angle of the plate and is independent of frequency. Therefore, the phase error at other frequencies is given by:

$$\text{Phase Error}(\theta)=[l_D(0)-l_D(\theta)][(k_g-k_{gD})]+(k-k_D)F(1-\cos\theta) \tag{13}$$

The maximum phase error occurs at the edge of the lens where $l_D(\theta)=0$, and is given by $$\Phi_{max}=l_D(0)[(k-k_D)-(k_g-k_{gD})]+(k-k_D)F(1-\cos\theta) \tag{14}$$

Figure 4B:
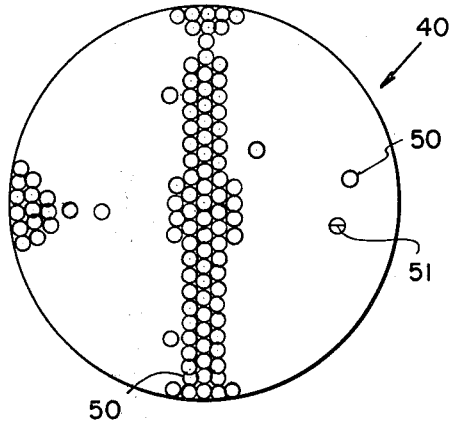
FIG. 4*b* is a diagram illustrating a front view of a waveguide lens according to the present invention.

Referring briefly to FIG. 4*b*, the aperture side of the lens 40 is shown. As described above, the lens 40 is composed of an array of uniformly spaced waveguide sections.

Figure 5:
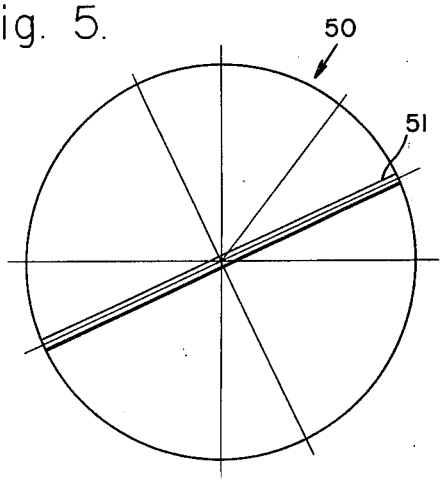
FIG. 5 is a diagram depicting a waveguide having a half wave plate element according to the present invention.
Figure 6:
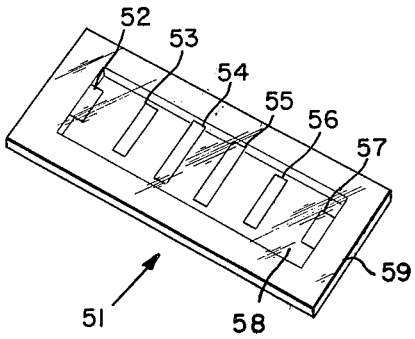
FIG. 6 is a diagram illustrating a half wave plate element according to the present invention.

Referring now to FIGS. 5 and 6, a half wave plate 51 within a waveguide section 50 is now discussed. The half wave plate 51 is an array of six metallic elements 52–57 that are etched on 3 mil polyimide film 58 clad with 0.5 mil copper as illustrated in FIG. 6. The film is held in place by a polyurethane foam frame 59 similar to a 35 mm photographic slide. The half wave plate 51 and the methods of producing such plates are well known in the prior art and, therefore, the methods will not be discussed in any greater detail.

Referring again to FIG. 5, the effect of an imperfect half wave plate phase shifter is to produce, at the output of the lens, an orthogonally polarized wave component in addition to the principally polarized wave. The orthogonal component is not collimated by the lens, although the principal component remains perfectly collimated as long as the phase shifters remain identical in their phase-shift-versus-rotation-angle characteristic. The orthogonally polarized wave, being uncollimated, contributes mainly to orthogonally polarized sidelobes which are distributed like the feed pattern.

Consider a circularly polarized were incident on a section of waveguide with a half wave plate as shown in FIG. 5. At any instant of time, the circularly polarized wave is expressed as:

$$E_{xin}=\cos(\omega t-\theta) \tag{15a}$$

$$E_{yin}=\sin(\omega t-\theta) \tag{15b}$$

The input field referred to the primary axis in FIG. 4*a* is $$\overline{E}_{in}=\begin{bmatrix}\cos\theta_p & \sin\theta_p\\ -\sin\theta_p & \cos\theta_p\end{bmatrix}\begin{bmatrix}E_{xin}\\ E_{yin}\end{bmatrix}=\begin{bmatrix}E_x'\\ E_y'\end{bmatrix} \tag{16}$$

The phase shifter plate affects only the E component in the plane of the plate, viz., $E_x'$. Consequently, the wave emerging from the waveguide section is given by $$\overline{E}_o' = \begin{bmatrix} E_x' e^{-j\Phi} \\ E_y' \end{bmatrix} \tag{17}$$

where $\Phi$ is the phase differential in the phase plate; ideally $\Phi$ equals 180°. The components of $E_o'$ on the unprimed axes in FIG. 5 are $$\begin{bmatrix} E_{x0} \\ E_{y0} \end{bmatrix} = \begin{bmatrix} \cos\theta_p & -\sin\theta_p \\ \sin\theta_p & \cos\theta_p \end{bmatrix} \begin{bmatrix} E_x' e^{-j\Phi} \\ E_y' \end{bmatrix} \tag{18}$$

Expanding (18) and substituting the components $E_x'$ and $E_y'$ from the expansion of (16) gives $$E_{x0} = E_{xin}(\cos^2\theta_p\, e^{-j\Phi} + \sin^2\theta_p) + E_{yin}(\sin\theta_p\cos\theta_p\, e^{-j\Phi} - \sin\theta_p\cos\theta_p) \tag{19a}$$

$$E_{y0} = E_{xin}(\sin\theta_p\cos\theta_p\, e^{-j\Phi} - \sin\theta_p\cos\theta_p) + E_{yin}(\sin^2\theta_p e^{-j\Phi} + \cos^2\theta_p) \tag{19b}$$

The input and output field angles are given by $$\tan\theta_i = \frac{E_{yin}}{E_{xin}} \tag{20}$$

$$\tan\theta_0 = \frac{E_{y0}}{E_{x0}} \tag{21}$$

Substituting equations (19) into (21) then yields $$\tan\theta_0 = \frac{\sin\theta_p\cos\theta_p(e^{-j\Phi} - 1) + \frac{E_{yin}}{E_{xin}}(e^{-j\Phi}\sin^2\theta_p + \cos^2\theta_p)}{e^{-j\Phi}\cos^2\theta_p + \sin^2\theta_p + \frac{E_{yin}}{E_{xin}}\sin\theta_p\cos\theta_p(e^{-j\Phi} - 1)} \tag{22}$$

If $\Phi = 180°$, equation (22), with a substitution from (20), reduces to the simple relationship $$\tan\theta_o = \tan(\theta_i + 2\theta_p) \tag{23}$$

The output phase is shifted by twice the physical rotation angle $\theta_p$ of the half wave plate as it should be.

With substitutions from (15), the output field components in (19) can be written as a circularly polarized wave:

$$E_{x0} = \left\{ \cos\frac{\Phi}{2}\cos\omega t - j\sin\frac{\Phi}{2}[\cos(\omega t - 2\theta_p)] \right\} e^{-j\Phi} \tag{24a}$$

$$E_{y0} = \left\{ \cos\frac{\Phi}{2}\sin\omega t - j\sin\frac{\Phi}{2}[\sin(\omega t - 2\theta_p)] \right\} e^{-j\Phi} \tag{24b}$$

Grouping the real parts of $E_{x0}$ and $E_{y0}$ gives a circularly polarized wave of the same sense as the incident wave with amplitude proportional to $\cos\Phi/2$, and with no phase change due to the plate angle $\theta_p$; hence, this wave remains uncollimated. Grouping the imaginary parts gives a circularly polarized wave of the opposite sense as that incident from the feed, and is phased by a phase of twice the plate angle, which is correct for beam collimation. Hence, this component of the wave is perfectly focussed by the lens even if there is an imperfect waveplate, that is, $\Phi \neq 180°$. The magnitude of this collimated wave is proportional to $\sin\Phi/2$ and the magnitude of the uncollimated wave is proportional to $\cos\Phi/2$.

In the ideal case where $\Phi = 180°$, all the incident power is in the collimated wave and none is in the uncollimated wave. With an imperfect plate, the fraction of power in the collimated wave is $\sin^2\Phi/2$ and the fraction in the uncollimated wave is $\cos^2\Phi/2$.

A waveguide lens according to the present invention has been reduced to practice. The lens is 46" in diameter and is comprised of cylindrical aluminum waveguide sections spot welded together. The waveguides have an inside diameter of 1.061" and a wall thickness of 0.010". After spot welding the waveguide sections together, the whole lens is dipped into an acid bath to etch the walls of the waveguide sections, thereby reducing the thickness to 0.006" for weight reduction. The waveguide diameter was chosen to optimize the lens impedance match to free space. The lens parameters are:

D=46"=lens diameter

F=72"=focal length=inner surface radius

Outer Surface—part of ellipse $$\text{semi-major axis} = F\left(1 - \frac{v_g}{c}\right)^{-1} = 179.3 \text{ inches}$$

semi-minor axis=F=72.0 inches $L_o$=5"=center element length exclusive of half wave plate section $L_H$=2.08"=length of $\lambda/2$ plate $L_{max}$=thickness at center=$L_o+L_H$=7.08"

Waveguide Element=1.061" I.D.

The characteristics of the horn which was used to illuminate the lens are:

Feed Horn

Hexagonal aperture 3.17" flat face to flat face

Equivalent flare angle=15°

Circularly polarized

Multimode

Feed illumination taper—5 dB.

Figure 8:
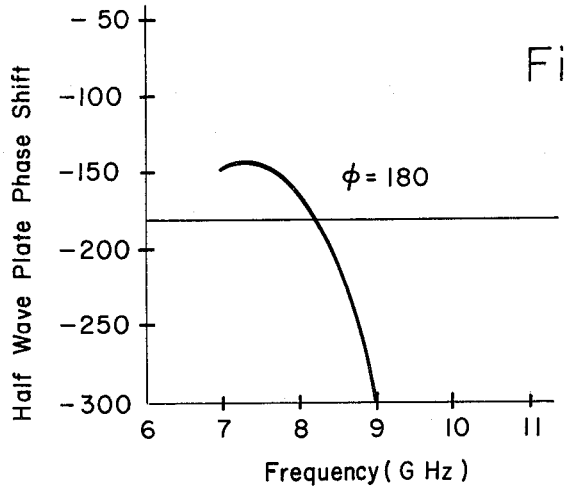
FIG. 8 is a diagram illustrating the differential phase shift versus frequency of a half-wave plate.

Antenna patterns and gain were taken at frequencies ranging from 7.4 to 9 GHz. FIGS. *7a–7c* show the measured on-axis beam patterns. It can be seen that the patterns remain well focused for all frequencies in this range even though, as seen in FIG. 8, the half wave plate deviates greatly from the desired differential phase of 180° over this band.

For this lens no attempt wave made to make the half wave plate broadband, although broadening the bandwidth can be accomplished by utilizing a longer waveguide section having more elements. FIG. 8 shows the differential phase versus frequency of the half wave plate. It can be seen that the differential phase at 9 GHz is 295° instead of 180°. Even so, as discussed earlier, this does not affect the aperture phase for the principal polarization, but causes a power loss to the unfocused orthogonal polarization. As shown by equations (24), the power in the principal polarization is proportional to $\sin^2(\Phi/2)$, while that in the orthogonal polarization is proportional to $\cos^2(\Phi/2)$. From FIG. 8 it is seen that at 9 GHz the measured magnitude of $\Phi$ is about 300°, or $\Phi/2$ is about 150°. The power loss to cross polarization at this frequency is therefore about $[1-\cos^2(150°)]$, or about 6 dB.

Figure 9A:
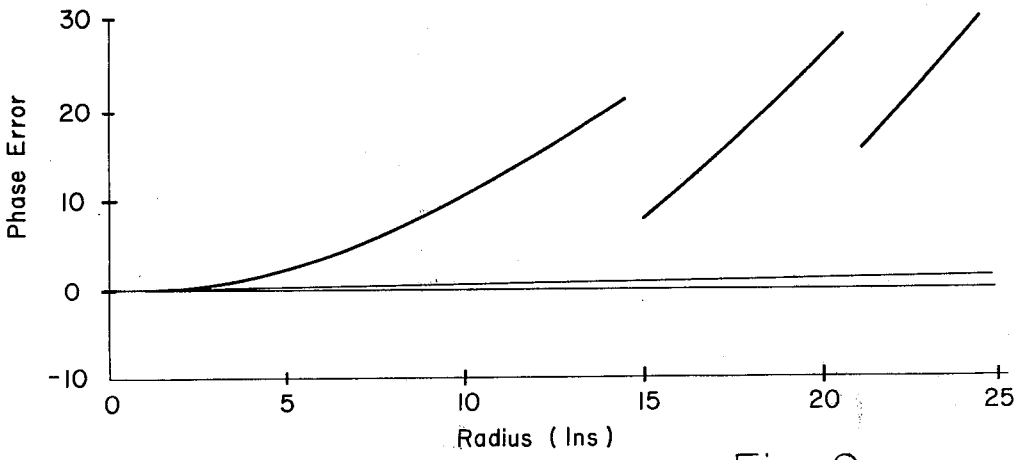
FIG. 9*a* is a diagram illustrating the aperture phase error of a conventional waveguide lens and the present invention.
Figure 9B:
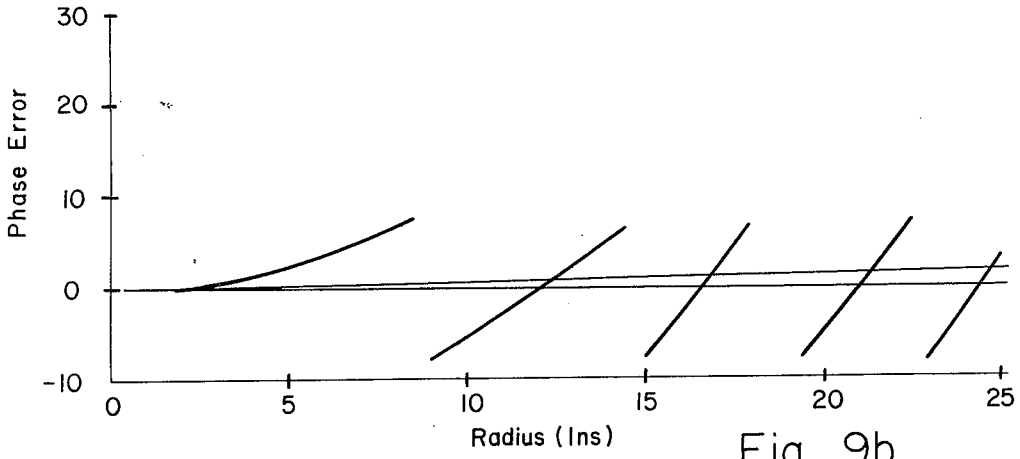
FIG. 9*b* is a diagram illustrating the aperture phase error of a Coulbourn lens and a lens according to the present invention.

It may be seen from FIGS. 9*a* and 9*b* that in the lens according to the present invention all the rays from the focal point to the aperture plane have equal time delay at the design frequency. Equal time delay results in minimum aperture phase deviation as a function of frequency, as is obvious from the two figures. The equality of time delay does not ensure equality of phase; therefore, the proper adjustment was made by utilizing half wave plate phase shifters in each waveguide element. This results in an aperture phase distribution which remains essentially constant over a much greater bandwidth than the other lenses. From the figures it is apparent that the aperture phase distribution of the conventional zoned lens and the Coulbourn zoned lens is much greater than the aperture phase distribution of a lens according to the present invention. With a frequency as little as 2% off the design frequency the conventional zoned lenses show appreciable aperture phase error, while the present invention has a maximum phase error of only 1°.

Referring briefly to FIG. 10, a lens 60 according to another embodiment of the present invention has a planar surface 61 and a hyperbolic surface 62. The planar surface is directed toward the focal point 11 and the hyperbolic surface is directed toward the aperture plane 12. As was discussed above the surfaces 61 and 62 may be directed toward the aperture plane 12 and the focal point 11, respectively.

Although the invention has been shown and described with respect to particular embodiments, various changes and modifications by those skilled in the art to which the invention pertains are nonetheless deemed to be within the purview of the present invention.

What is claimed is:

1. A broad bandwidth waveguide lens for processing electromagnetic wave energy emanating from a focal point to provide a desired phase distribution at an aperture plane comprising:

an array of adjacent hollow metallic waveguide elements having parallel longitudinal axes disposed perpendicular to said aperture plane with one of said axes passing through said focal point, each of said waveguide elements having an input port facing said focal point and an output port facing said aperture plane, the respective lengths of said waveguide elements decreasing as a function of transverse distance from said one axis such that the same time delay is provided for electromagnetic wave energy traveling from said focal point to said aperture plane via each of said waveguide elements, and half wave plate phase shifting means disposed in each of said waveguide elements for providing a predetermined phase shift for electromagnetic wave energy propagating through the said waveguide element to provide said desired phase distribution.

2. The invention according to claim 1 wherein the respective locations of the input ports of said waveguide elements relative to said focal point satisfy the Abbe sine condition.

3. The invention according to claim 2 wherein the input ports of said waveguide elements define a segment of a spherical surface having a radius equal to the focal length of said lens.

4. The invention according to claim 1 wherein the output ports of said waveguide elements define a segment of an ellipsoidal surface having a semi-minor axis equal to said focal length and having a predetermined semi-major axis.

5. The invention according to claim 1 wherein the input ports of said waveguide elements form a first smooth boundary and the output ports of said waveguide elements form a second smooth boundary.

6. The invention according to claim 5 wherein said first and second smooth boundaries are concave and convex surfaces respectively.

7. The invention according to claim 5 wherein said first and second smooth boundaries are planar and hyperbolic surfaces, respectively.

8. The invention according to claim 6 wherein said first smooth boundary defines an Abbe sine condition.

9. A broad bandwidth microwave system utilizing a waveguide lens comprising:

wave generating means for generating electromagnetic wave energy;

a waveguide lens for processing electromagnetic wave energy emanating from said wave generating means to provide a desired phase distribution at an aperture plane, said lens including an array of adjacent hollow metallic waveguide elements having parallel longitudinal axes disposed perpendicular to said aperture plane with one of said axis passing through said wave generating means, each of said waveguide elements having an input port facing said wave generating means and an output port facing said aperture plane, the respective lengths of said waveguide elements decreasing as a function of transverse distance from said one axis such that the same time delay is provided for electromagnetic wave energy traveling from said wave generating means to said aperture plane via each of said waveguide elements, and half wave plate phase shifting means disposed in each of said waveguide elements for providing a predetermined phase shift for electromagnetic wave energy propagating through the said waveguide element to provide said desired phase distribution.

10. The invention according to claim 9 wherein said wave generating means comprise:

a millimeter transmitter means for generating millimeter waves.

* * * * *